United States Patent [19]

Bowering

[11] Patent Number: 4,564,844

[45] Date of Patent: Jan. 14, 1986

[54] COLLAPSIBLE BROADBAND DIRECTIONAL ANTENNA

[76] Inventor: Cyril J. Bowering, 1481 Northdale St., Gloucester, Ontario, Canada, K1B 4G6

[21] Appl. No.: 610,809

[22] Filed: May 16, 1984

[30] Foreign Application Priority Data

Sep. 1, 1983 [CA] Canada ..... 435855

[51] Int. Cl.[4] ..... H01Q 11/10; H01Q 1/08

[52] U.S. Cl. ..... 343/881; 343/792.5

[58] Field of Search ..... 343/792.5, 809, 846, 343/880, 881, 882

[56] References Cited

U.S. PATENT DOCUMENTS 4,262,293 4/1981 Parmer ..... 343/881

4,460,895 7/1984 Bert et al. ..... 343/881

*Primary Examiner*—Eli Lieberman

*Attorney, Agent, or Firm*—Cushman, Darby & Cushman

[57] ABSTRACT

A compact collapsible broadband directional VHF antenna is disclosed. The antenna is comprised of radiating elements consisting of rods in a Vee configuration, the rods being incorporated into a mechanism in which a series of insulating links are used to raise the antenna with a low and uniformly applied force. Associated with these are phasing elements physically shortened by capacitive loading.

16 Claims, 6 Drawing Figures

COLLAPSIBLE BROADBAND DIRECTIONAL ANTENNA

This invention relates to antennas, more particularly to broadband VHF antennas.

There are a number of antenna types in use which provide broadband directional performance at VHF. The type most commonly used where a compact antenna is necessary are logarithmic periodic arrays of wire or rod elements. These antennas are normally comprised of a series of half wave dipole elements or quarter wave monopoles supported over a ground plane. The antenna of this invention is a vertically polarized antenna operating in the VHF band having a broadly directional radiation pattern and significant forward gain.

Dipole arrays for the frequency band of interest employ elements of an unacceptable length for many applications and would also need some elevation above the ground plane for satisfactory performance. Monopole arrays currently in use utilize an extensive ground plane area with a width of at least one-half wavelength at the lowest operating frequency. At 30 MHZ, this would entail a horizontal structure 5 meters in width. These antennas differ mainly in the method employed to provide the necessary phase shift between adjacent elements.

The antenna proposed in this invention presents an inconspicuous profile when not in use and is capable of rapidly assuming its operational form. The antenna would be able to function in conditions of shock and vibration such as would be encountered if the antenna was mounted on a vehicle in motion over uneven terrain.

Particular embodiments of the invention will be described in conjunction with the accompanying drawings.

Figure 1:
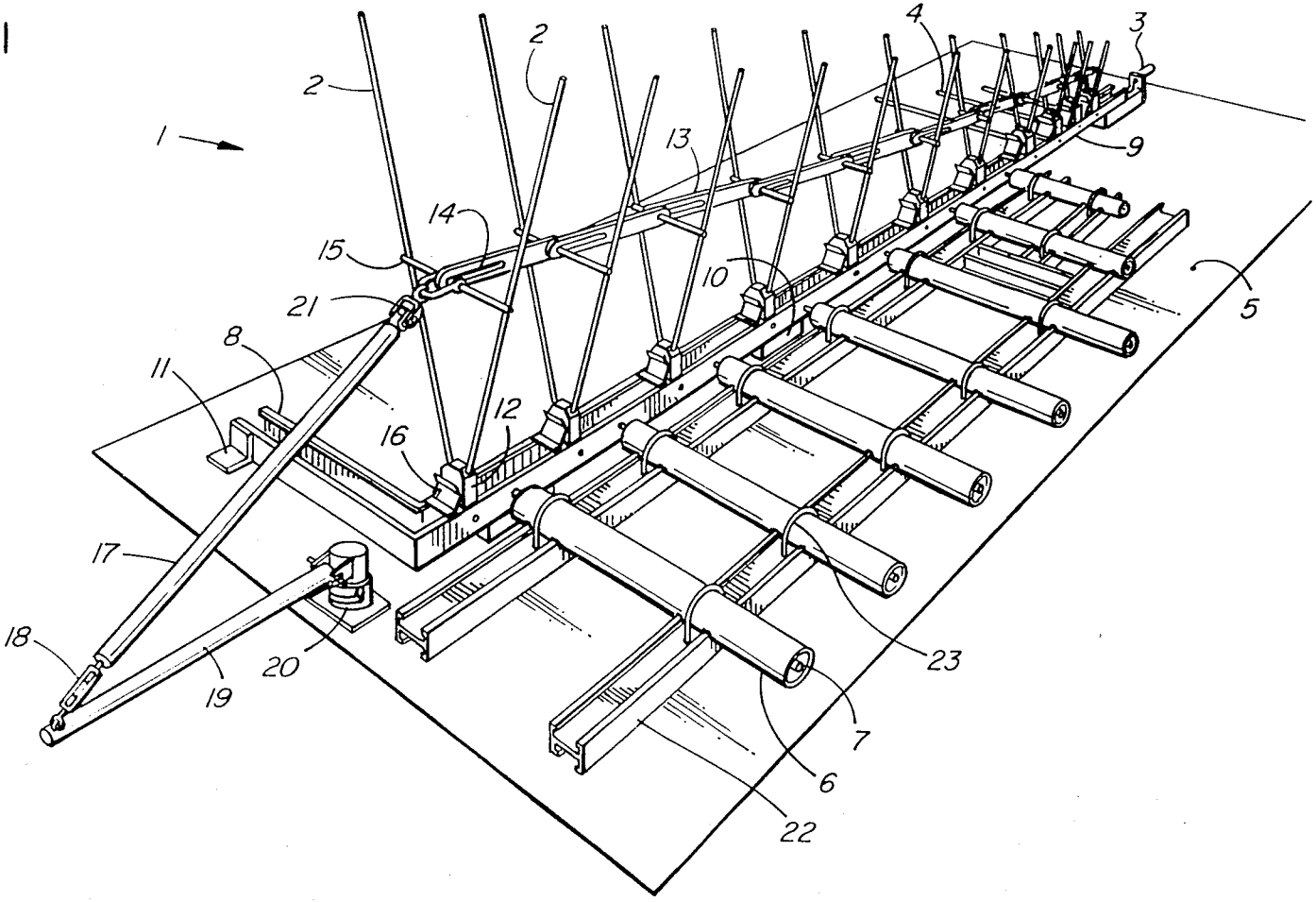
FIG. 1 is a perspective view of the antenna in its erected position.

Referring now to FIG. 1, the antenna of this invention is indicated generally at 1. A number of radiating elements (2) are used with a number of phasing lines. The phasing lines closest to the antenna feed point (3) are open lines (4). These phasing lines are open circuit $\frac{1}{4}$ wavelength and connected between radiating elements (2) to provide a short circuit at the geometric mean of the resonant frequencies of adjacent elements. However, if a ground plane (5) is too small to accommodate lower frequency lines of this type, then the remaining lines have to be shortened. This can be achieved by capacitor loading of open lines, by use of flexible coaxial cable cut to length, series tuned circuits using lumped L and C of appropriate Zo, or loaded coaxial lines as shown at (6) in FIG. 1 and detailed in FIG. 6. These phasing lines are electrically lengthened by means of an internally mounted shunt loading capacitor (7). The loaded coaxial line is the preferred method used because it provides a means of fine tuning and provides integral environmental protection for the tuning capacitor. The phasing lines (6) are secured to a support (22) by means of a U-Bolt (23) and mounted on the ground plane (5).

The use of loaded coaxial phasing lines makes it possible to use a much narrower ground plane. In addition a worthwhile reduction in the ground plane length requirement is achieved by attaching a terminating section (8) at a right angle to a main signal feed line (9). It may be seen that the feed line (9) is insulated from ground through its length by insulators (10) whereas the terminating section (8) is grounded at its extremity (11).

With this restricted ground plane area, simple linear vertical elements no longer provide satisfactory electrical performance. In the present invention the radiating elements are two rods in the form of a Vee (2) and these give the required impedance and field pattern characteristics.

Physically, the antenna is designed so that the elements lay in the horizontal position when not in use. Quick erection is facilitated by a special mounting assembly (12) at the base of each Vee element and series of non-conducting links (13) attached to the element crossbars (15). The force required to raise any one element is at a maximum when the element is horizontal and decreases to zero in the vertical position. Consequently, if all elements were raised simultaneously an extremely high initial force would be demanded.

Using the mechanism illustrated, the elements are raised sequentially and the force required throughout the lifting procedures is almost constant. With the elements in the vertical position the same force is sufficient to fully engage the contact springs (16). (See also FIG. 4.)

The antenna erection is initiated by a fold down system which consists of an antenna raiser (17) attached at one end to a turnbuckle (18) and at the other end to a universal type coupling (21) joining said antenna raiser to an element crossbar (15). The turnbuckle assembly is connected to a raising arm (19) which is further connected to the mast raiser base assembly (20).

As the antenna raiser (17) is pulled, the first pair of radiating elements will be raised. The pulling force required will then change from a maximum, when the element is collapsed, to a minimum when the first element crossbar (15) has travelled to the end of the first element raising link slot (14). Having reached the end of the slot (14) the raising link (13) will then activate the second crossbar and hence the required pulling force will again increase to a maximum due to the force needed to begin lifting the second pair of radiating elements. This maximum/minimum force requirement averages out to overall pulling force as applied, that is generally constant. This process will then be repeated until the last pair of radiating elements has been raised.

In order to lower the antenna from its erect position as shown in FIG. 1 to a collapse position, the raising arm (19) is allowed to rotate about the base assembly (20) and hence permit antenna raiser (17) to move thus allowing the radiating elements to be lowered by the pull of gravity and the biasing contact spring (16).

In the embodiment described, the element raising links (13) are rigid. It will be appreciated by those skilled in the art that the links can also consist of any joining means, i.e., rope, bungee cord, cord, etc. Further, in the embodiment of the antenna described, the raising arm (19) and antenna raiser (17) fold down system can also consist of simple cord and pully arrangement, all of which are capable of being motorized. Here a cord can be secured between each successive pair of radiating elements, lengthwise of the antenna (1). Another cord and pulleys could replace the parts of the antenna raiser (17).

By varying the length of the individual radiating elements and phasing lines according to known techniques, the antenna can be made to operate in a number of frequency bands. This will be understood by those knowledgeable in this art and need not be described here for an understanding of the present invention.

Figure 2:
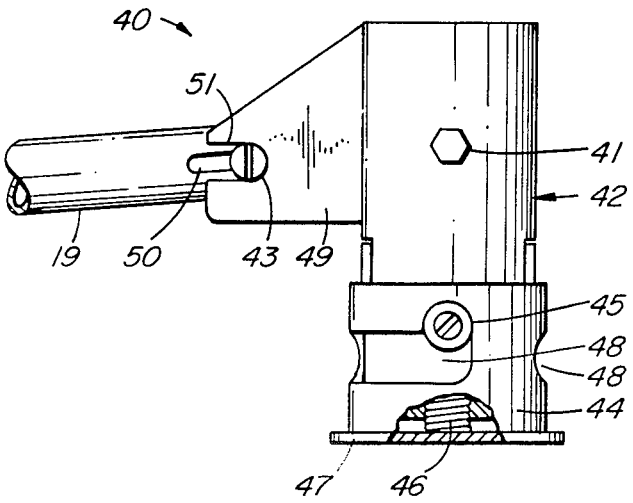
FIG. 2 is a side view of the mast raiser base assembly.

Referring now to FIG. 2, the mast raiser base assembly is shown generally at (40). A side view of the mast raiser base assembly is shown with a cut away view of the base (42) and pivot base (44) also showing a mast raiser spring (46).

The mast raiser assembly (40) is secured by means of a mounting plate (47). The pivot base (44) is attached to said mounting plate (47) and provided with slots (48) so as to control the movement of roller bearings (45), said bearing being part of the base (42). The slots (48) are diametrically opposite each forming an L-shaped figure. The slots permit the roller bearing (45) to be locked in place. The base (42) is supported within the pivot base (44) by the spring (46). The spring (46) permits axial and rotational movement of the base (42) with respect to the pivot base (44). With the bearing (45) in the L-shaped slot (48), rotation of the base (44) is prevented. Pressing down on the base (44) will release the bearing (45) from its locked position and permit the rotation of the base. Supporting member (49) is integrally connected to the base (42) and is provided with a slot (51) so as to permit the raising arm pin (43) to lock in member (49) as shown in FIG. 2 thus preventing the raising arm (41) from rotating in an upward or downward motion.

In order to lower the radiating elements, the following procedures should be followed; raising arm (19) can be made to rotate by pulling raising arm pin (43) outside slot (51) of supporting member (49). Having done so, the arm can now be rotated from a horizontal to a vertical position hence permitting the radiating elements to be lowered. By first applying pressure on base (42) and then rotating said base with respect to the pivot base (44), roller bearing (45) can be made to move freely within the slot (48) and permitting the raising arm base assembly to rotate to a right angle position from the position of FIG. 2. Once rotated the raising arm can be lowered from a vertical to a horizontal position. The raising arm pin (43) will slide along the slanted surface of member (49) and lock into slot (51).

Figure 3:
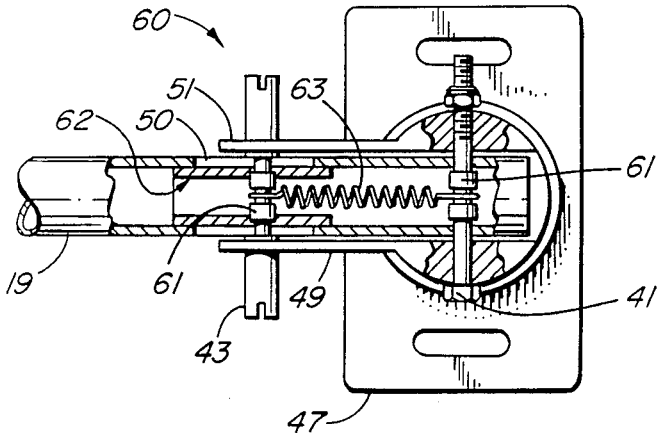
FIG. 3 is a partially sectioned top view of the mast raiser base assembly.

Referring now to FIG. 3, shown generally at (60) is a cut away view of the base assembly. Bolt (41) provides a pivot for raising arm (19). The raising arm pin member (43) is provided with spacers (61) and a pin guide (62) allowing proper chanelling of the pin (43) through the raising arm slot (51) shown in FIG. 2. Tension is kept on pin (43) by means of spring (63) attached at one end to said pin and at its other end to bolt (41). It will be appreciated by those skilled in the art that the mast raiser base assembly of FIGS. 2 and 3 can also consist of a ball bearing/socket arrangement or any other pivotable base assembly permitting the movements described above.

Figure 4:
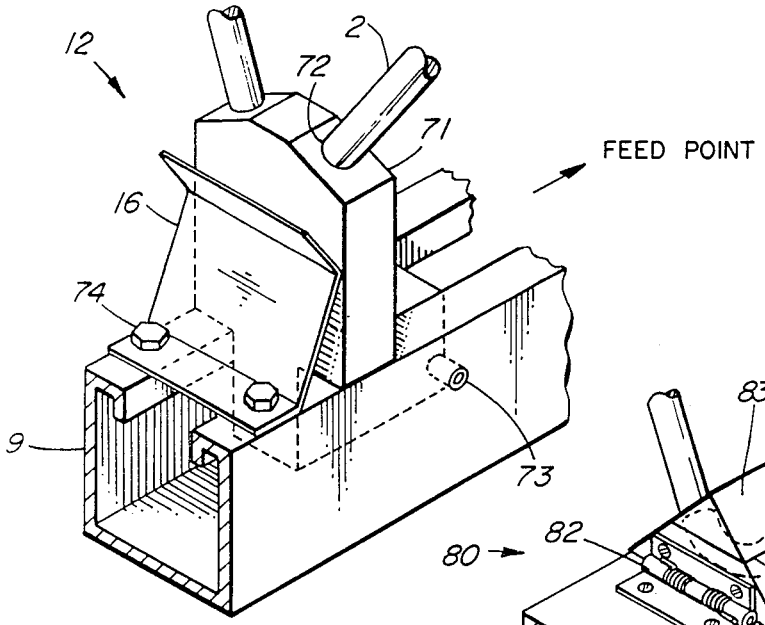
FIG. 4 is a perspective view of the mounting assembly seen from the terminating end.

Referring to FIG. 4, the radiating element mounting assembly is shown generally at (60). An L-shaped support (71) holds the radiating elements (12). Silver solder or soft soldering (72) is used to secure the copper clad steel radiating elements (2) as well as to provide electrical contact therebetween. Support (71) is attached to feed line (9) by means of a spring tension pin (73) allowing rotation of the support around said pin. Contact spring (16) is attached to the feed line (9) by means of bolts (74) and provides electrical contact between the element support (71) and feed line (9). The spring (16) is shaped to provide a tension on said support and hence facilitate the folding of the antenna. It will be appreciated by those skilled in the art that the electrical conductor function of the contact spring (16) can be replaced by an electrical wire or braided conductor connected between said support and centre beam.

Figure 5:
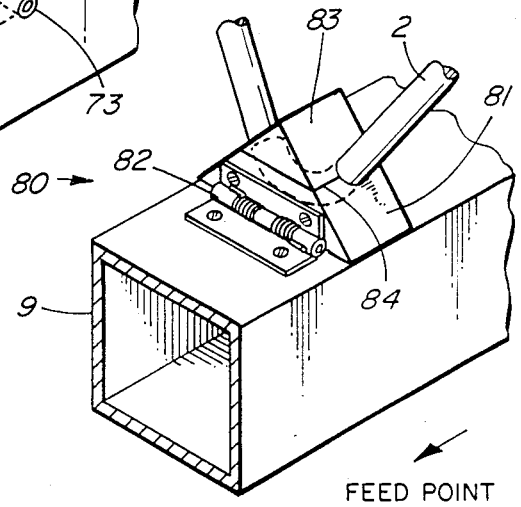
FIG. 5 is a perspective view of another embodiment of the mounting assembly seen from the feed point.

Referring now to FIG. 5, reference numeral (80) shows another embodiment of the mounting assembly shown in FIG. 4. The assembly consists of a simple triangular shaped support having a lower section (81) and an upper section (83). The upper and lower sections are shaped at their junction (84) to permit a single radiating element (2), bent in a Vee, to be in electrical contact and secured between the two sections. Soldering can be used to secure the upper and lower sections together at their junction (84). The lower section (81) fits squarely on the feed line (9) and is provided with a simple spring loaded hinge (82) attached to said feed line. The hinge (82) allows the radiating elements to be lowered. The mounting assembly can be electrically connected to the feed line (9) by utilizing the contact spring (16) of FIG. 4, the spring loaded hinge (82) or a simple electrical conductor.

Figure 6:
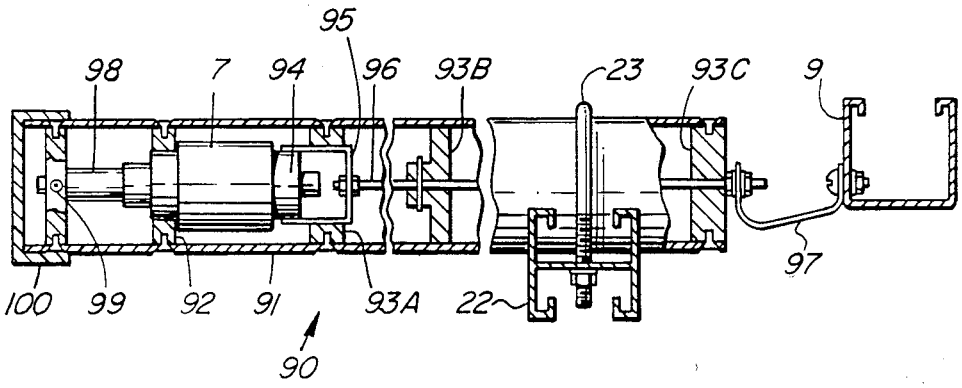
FIG. 6 is a cut away view of the coaxial phasing line.

Referring now to FIG. 6, shown at reference numeral (90) is a detailed view of the coaxial phasing line previously shown at reference number (6) in FIG. 1. The phasing line consists of a housing (91) which is secured to a support (22) by means of a U-Bolt 23. The housing support arrangement is mounted over a ground plane (5) as shown in FIG. 1. The phasing line is electrically lengthened by means of a small tuning capacitor (7). The capacitor is commercially available in various sizes. For example, a JENNINGS, Model No. CADC-30 was used for this application. The capacitor (7) is supported inside the housing (91) at various locations by means of collar-like supports (92) and ring insulators shown at (93A), (93B) and (93C). The tuning capacitor is connected to the feed line (9) at contact member (94), by means of a contact clamp (95) connected to a connecting rod (96) which is further connected to a braided conductor shown at (97). The phasing line can be electrically adjusted by fine tuning the capacitor (7) by means of a rotatable shaft (98). Once a proper adjustment has been made, the rotatable shaft (98) can be locked in place by means of a set screw (99). The tuning capacitor arrangement is protected from the environment by means of a weather seal (100) positioned at the open end of the phasing line.

It will be understood by those skilled in the art that the phasing means is not limited to this configuration.

The embodiments of the invention in which an exclusive property or privilege is claimed are defined as follows:

1. A compact collapsible broadband directional monopole antenna adapted to be electrically connected to and positioned over a ground plane, comprising:

a plurality of radiating elements each element being electrically connected to a feed line and mounted on said feed line by means of a mounting assembly;

phasing means provided by a number of phasing lines electrically connected to said feed line; and raising means being provided by a combination of joining means attached to individual radiating elements, said joining means being activatable by an antenna raiser attached at one end to said joining means and at the other end to a raising arm, said raising arm being pivotably attached to a base thereby to enable said elements to be raised sequentially with a relatively constant tension derived in response to a force applied to the raising arm.

2. An antenna as defined in claim 1, wherein the raising means comprises:

an antenna raiser attached at one end to the raising arm and at the other end to the joining means of a radiating element, said joining means being provided between the end radiating element and the radiating element closest to the feed point so as to enable said radiating elements to be selectively raised and lowered in response to an applied pulling force, said raising arm being connected at one end to one of an inner and outer element forming a base, each element being concentric and moveable one relative to the other to provide a range of pivotal movement of the raising arm.

3. An antenna as defined in claim 1, wherein the phasing means comprises:

a plurality of open phasing lines for elements, closest to the antenna feed point, radiating the higher frequencies, said open phasing lines being electrically connected to the feed line between said radiating elements; and a plurality of coaxial phasing lines for the remaining elements radiating the lower frequencies, said coaxial phasing lines being electrically connected to the feed line between said remaining radiating elements, said coaxial phasing lines being provided with electrical tuning adjustments.

4. An antenna as defined in claim 1, wherein the mounting assembly comprises:

an antenna element support placed on a feed line and attached to said feed line so as to provide rotation of said element support about an axis horizontal and perpendicular to the central axis of said feed line allowing said radiating elements and said element support, to be rotated from a collapsed horizontal position to an erect vertical position; or form an erect vertical position to a collapsed horizontal position; and a contact spring attached to said feed line such as to provide an opposing tension when the antenna element support is raised also providing electrical contact between said element support and feed line.

5. An antenna as defined in claim 1, wherein said feed line comprises:

at one end, an antenna feed point which consists of an antenna connector electrically attached to said feed line, said feed line being insulated from the ground plane through its length by insulators, and at its other end, a terminating section grounded at its extremity.

6. An antenna as defined in claim 5, wherein said feed line further comprises:

a terminating section attached to said signal feed line at a right angle.

7. An antenna as defined in claim 3, wherein the phasing means further comprises:

a plurality of coaxial phasing lines electrically lengthened by means of internally mounted shunt loading capacitors.

8. An antenna as defined in claim 1, wherein the radiating elements comprise:

a plurality of rods joined in pairs at a common point to said feed line by means of hinges, said pairs forming a Vee configuration.

9. An antenna as defined in claim 8, wherein the radiating elements are made of copper clad steel.

10. An antenna as defined in claim 8, wherein the radiating elements are secured and electrically attached to the hinge by one of soft solder and silver soldering.

11. An antenna as defined in claim 2, wherein said joining means comprises:

a plurality of element raising links individually attached between element crossbars, said crossbars being attached across each pair of rods.

12. An antenna as defined in claim 9, wherein the joining means further comprises:

a plurality of element raising links, said raising links being non-conductive.

13. An antenna as defined in claim 1, wherein the mounting assembly comprises:

a simple triangular shaped support placed on a feed line having a lower and upper section, said sections being shaped at their junction so as to permit a single radiating element, bent in a Vee, to be in electrical contact and secured between said upper and lower sections;

a spring loaded hinge attached between the lower section and said feed line so as to provide rotation of said triangular shaped support about an axis horizontal and perpendicular to the central axis of said feed line allowing said radiating elements, to be rotated from a collapsed horizontal position to an erect vertical position, or from an erect vertical position to a collapsed horizontal position;

electrical connecting means provided between the triangular shaped support and said feed line; and securing means provided between upper and lower sections.

14. An antenna as defined in claim 11, wherein the electrical connecting means consist of:

a contact spring attached to said feed line providing electrical contact between said element support and feed line and also providing an opposing tension when the antenna element support is raised.

15. An antenna as defined in claim 11, wherein the electrical connecting means consist of:

an electrical conductor attached between the feed line and the element support.

16. An antenna as defined in claim 11, wherein the securing means consist of:

silver soldering between upper and lower sections.

* * * * *